United States Patent [19]

Clarke et al.

[11] 4,029,197

[45] June 14, 1977

[54] APPARATUS FOR HANDLING CIGARETTES OR OTHER ROD-LIKE ARTICLES

[75] Inventors: Peter Alec Clarke; Stanley Victor Starkey; William Alfred Stone, all of Deptford, England

[73] Assignee: Molins Limited, England

[22] Filed: Jan. 5, 1976

[21] Appl. No.: 646,845

[30] Foreign Application Priority Data

Jan. 17, 1975 United Kingdom ..... 2075/75

[52] U.S. Cl. ..... 198/425; 198/836

[51] Int. Cl.[2] ..... B65G 47/22

[58] Field of Search ..... 198/20 C, 34, 35, 37, 198/160, 425, 836

[56] References Cited

UNITED STATES PATENTS

| | | | |
|---|---|---|---|
| 3,190,434 | 6/1965 | Dardaine | 198/34 |
| 3,442,505 | 5/1969 | Szentkuti | 271/21 X |
| 3,561,585 | 2/1971 | McCombie | 198/37 X |
| 3,633,735 | 1/1972 | Molins et al. | 198/82 |
| 3,851,748 | 12/1974 | Garton | 198/34 |
| 3,917,049 | 11/1975 | Shirai et al. | 198/20 C |
| 3,923,146 | 12/1975 | Van Hall | 198/37 |

*Primary Examiner*—Evon C. Blunk
*Assistant Examiner*—Richard K. Thomson
*Attorney, Agent, or Firm*—Craig & Antonelli

[57] ABSTRACT

In apparatus for forming batches of cigarettes on a conveyor in which a divider plate is projected upwards into a stream on the conveyor a movable control plate is arranged in engagement with the upper surface of the stream in the region where the major part of the upward movement of the divider plate occurs. This plate has an ironing action on the stream and helps control and prevent misalignment of the uppermost cigarettes as the divider plate rises. A principal use for batch-forming apparatus of this type is with tray filling devices which transfer cigarettes into trays by successively plunging batches from a conveyor.

14 Claims, 2 Drawing Figures

APPARATUS FOR HANDLING CIGARETTES OR OTHER ROD-LIKE ARTICLES

Figure 1A:
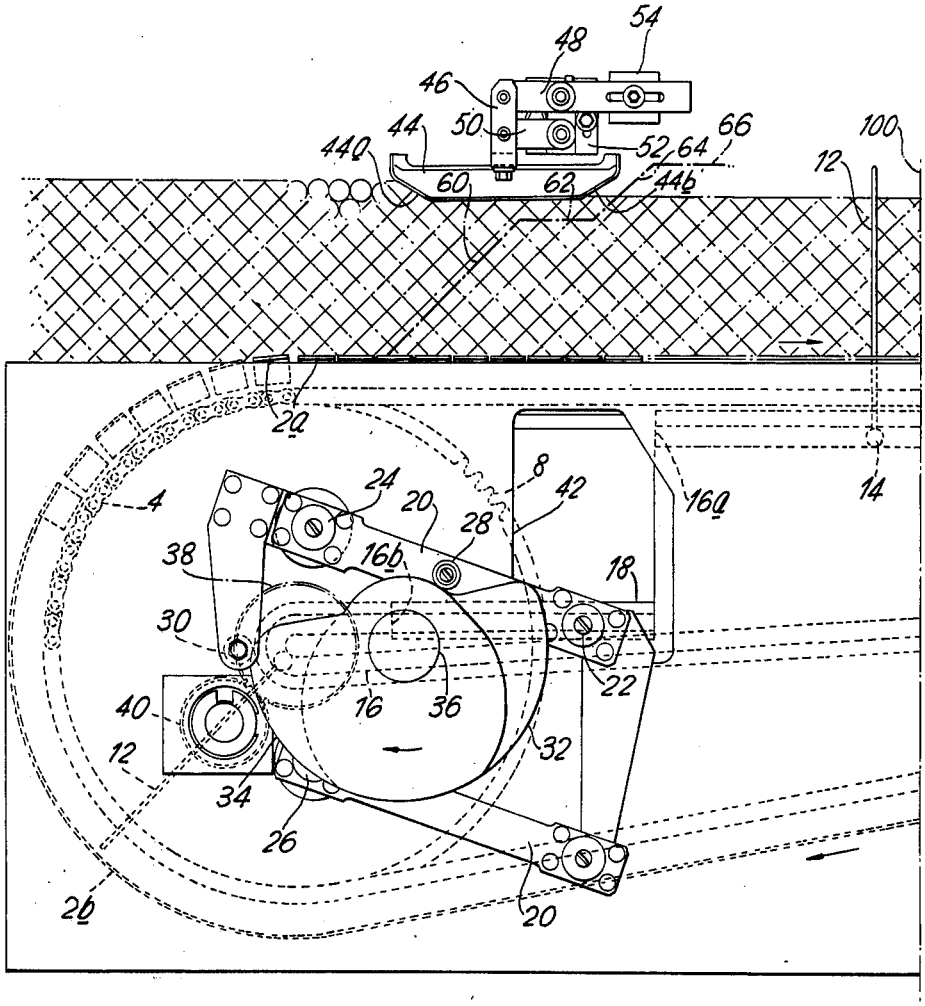

This invention relates to apparatus for handling cigarettes or other rod-like articles, and is particularly concerned with apparatus for dividing a stream consisting of a stack of cigarettes moving transverse to their lengths.

In cigarette-manufacturing processes, where rod-like articles such as cigarettes are required to be transported between different types of machines, e.g. between a making machine and a packing machine, it is frequently desirable to provide facilities for temporary storage of the rod-like articles in transit. Thus, some or all of the output of a cigarette making machine may be supplied to portable containers which may be unloaded subsequently, as required, for supply to a cigarette packing machine.

British patent specification No. 1,404,141 (U.S. patent application Ser. No. 276,302 now U.S. Pat. No. 3,967,740 and German Offenlegungschrift No. P2238062) discloses apparatus for filling such containers. In one form this apparatus includes means for feeding a stream consisting of a stack of rod-like articles moving transverse to their lengths, means operable to separate successive leading end portions of the stream to form successive batches of articles, and means for inserting each batch of articles into a container at a loading station. The leading end portion of the stream may be separated by projecting a divider plate into the stream. In one arrangement described in the above-mentioned specification the stream is supported on an endless conveyor provided with regularly spaced divider plates which can be either retracted below or projected through the conveyor to separate adjoining portions of the stream to form batches of rod-like articles. A batch so formed is bounded at its ends by divider plates and may be transferred to the container by appropriate means, e.g. by use of a pusher to push the batch transversely off the conveyor. For further details reference is directed to the above-mentioned patent specification.

The present invention is concerned with an improved apparatus for dividing a stream of rod-like articles by means of a divider plate, which apparatus may be used in conjunction with apparatus for filling containers as described in the said patent specification.

One aspect of the invention provides a method of dividing a stream consisting of a stack of rod-like articles moving transverse to their lengths in which dividing means moving with the stream is progressively projected into the stream, wherein the stream is compressed or restricted in the region where the dividing means is projected into the stream. The pressure exerted on the stream should be sufficiently light not to damage the rod-like articles and is preferably applied in such a way that it is substantially constant or varies to a predetermined degree with changes in depth of stream. The region over which the stream is compressed need not extend through the whole distance over which the dividing means is moving through the stream. The dividing means may be projected into the stream in two distinct stages: the stream may be compressed or restricted during the initial stage only (or during all or part of one or both stages).

Another aspect of the invention provides apparatus for dividing a stream consisting of a stack of rod-like articles, comprising conveyor means for supporting and moving the stream, dividing means associated with the conveyor means and arranged to be projected upwards into the stream from a lower position retracted below the conveyor means, guide means for causing movement of the dividing means from the lower position to an upper position in which the dividing means is fully projected through the stream, and pressure means for exerting a pressure on top of the stream over at least part of the region where the dividing means is moving through said stream.

The pressure means may comprise a plate spaced from the conveyor means and movable towards or away from the conveyor means. The plate may rest on top of the stream and exert pressure by virtue of its weight. Alternatively, or in addition, resilient means could be relied upon to supply or produce the required pressure. If the pressure means comprises a plate it is preferably fixed laterally but pivoted about a horizontal axis or otherwise movable in a generally vertical direction. As an alternative to a moving plate a moving or movable band could be used to apply pressure: the band could be resiliently mounted so that the necessary pressure could be applied. The band need not move at the same speed as the general movement of the stream. Instead of a plate or band the presure means could be a flexible strip, e.g. of plastics material, constrained so that it presses on the upper surface of the stream.

The conveyor means preferably has a low friction surface, such as that of a plastics material, so that movement of the stream relative to the conveyor means is possible.

It is contemplated that apparatus for dividing a stream as herein defined may be embodied in apparatus for inserting rod-like articles into a container, the inserting apparatus comprising an endless conveyor for feeding a stream of rod-like articles in a direction transverse to their lengths; batch-forming means for successively forming articles from said stream into batches, said batch-forming means including said endless conveyor and spaced divider plates arranged to be projected through a stream of articles on said conveyor to separate a leading end portion from said stream to form a batch, each batch comprising a stack bounded at its ends by a divider plate; a loading station; means for conveying a succession of containers through said loading station; and means for transferring successive batches of articles from said conveyor into containers at said loading station.

Such apparatus may form part of a system for conveying cigarettes or other rod-like articles in containers, the system including an article delivery device and an article receiving device, means for conveying containers, and means for unloading articles from containers.

It should be understood that the apparatus for inserting rod-like articles into a container (embodying apparatus for dividing a stream of rod-like articles, as herein defined) may be such that it is operable (or forms a substantial part of apparatus operable) in a reverse mode as apparatus for unloading rod-like articles from a container. For a fuller understanding of the operation and construction of such reversible apparatus reference is directed to the above-mentioned British patent specification No. 1,404,141.

The present invention will now be further described, by way of example, with reference to the accompanying drawing which shows in side elevation apparatus for dividing a stream of rod-like articles such as cigarettes. For convenience the drawing comprises two parts, FIGS. 1A and 1B, which show two parts of the apparatus which are continguous at the chain-dotted line 100.

Figure 1B:
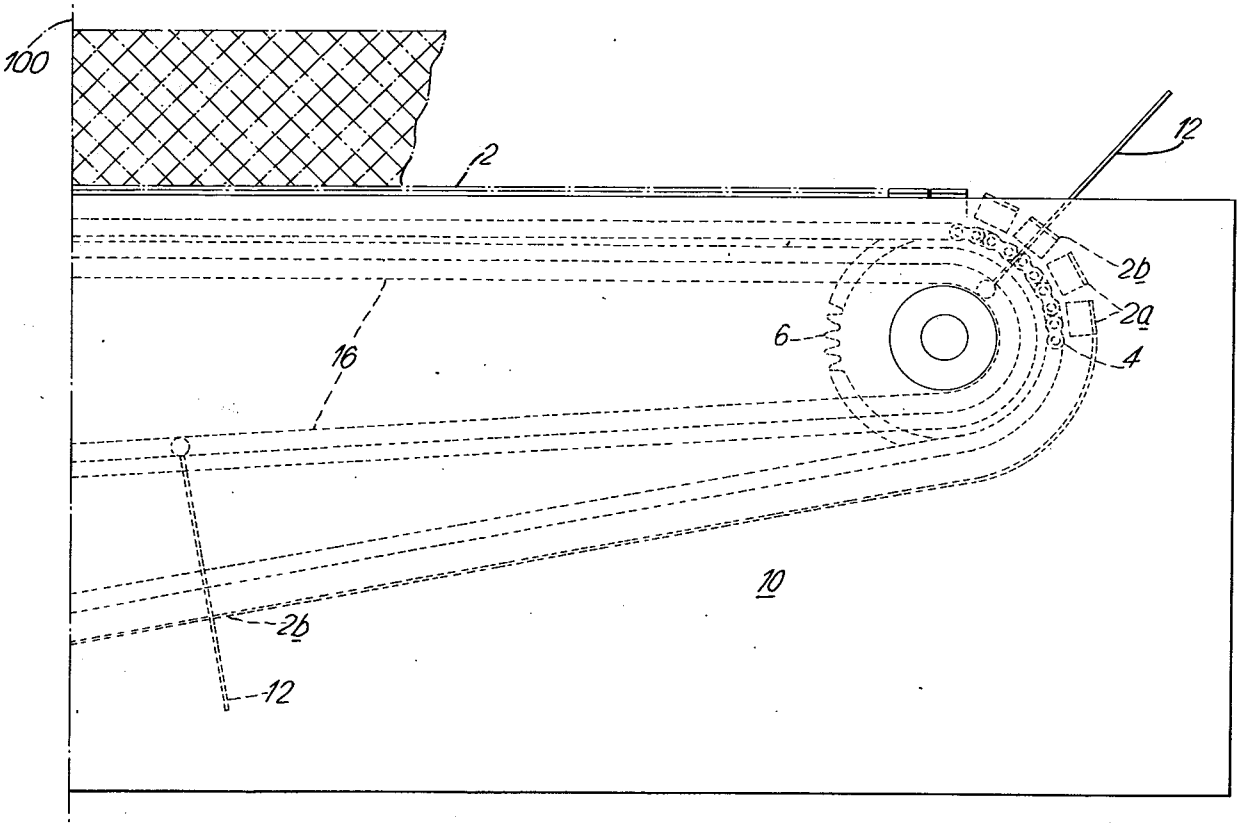

The drawing shows an endless slatted conveyor 2 having individual slats 2*a* which are supported at each end by a chain 4. The chain 4 on each side of the conveyor 2 passes around a small sprocket 6 (FIG. 1B) and a large sprocket 8 (FIG. 1A). The arrangement is such that the conveyor 2 has a substantially horizontal upper run and an inclined lower run. The apparatus includes side plates 10 which are arranged at each side of the conveyor 2 and rotatably support the sprockets 6 and 8. A servo motor (not shown) is mounted on one of the side plates 10 adjacent one of the sprockets 6 and is drivingly connected to both sprockets 6 for driving the chains 4 and conveyor 2.

At regularly spaced positions the conveyor 2 carries specially adapted slats 2*b* which have a guide slot for a divider plate 12. Each divider plate 12 has a width approaching that of the slats 2*a* and 2*b*. Although the conveyor 2 carries for regularly spaced divider plates 12 other lengths of conveyor may carry different numbers of such plates. The use of conveyors carrying single divider plates or irregularly spaced divider plates for specific purposes is not excluded. Each divider plate 12 is movable in the guide slot in its associated slat 2*b* so that it may be retracted below or projected above the surface of conveyor 2 and is constrained so that it remains perpendicular to the conveyor surface of the slat.

The inner end of each side of each divider plate 12 carries a roller 14 which projects into a channel member 16 mounted on the inner face of the adjacent side plate 10. The rollers 14 are movable along the channel members 16, which define parallel paths on each side of the conveyor 2. From one end 16*a* each channel member 16 runs parallel to and adjacent the horizontal upper run of conveyor 2 to the small sprocket 6. The perpendicular spacing between the channel members 16 and the conveyor 2 remains the same around the sprockets 6 but subsequently the inclined lower run of conveyor 2 and the lower run of the channel members 16 progressively diverge until in the region of the large sprockets 8 the spacing is approaching the radius of the sprockets 8. This spacing is maintained around the sprockets 8 and along a short horizontal section to the other end 16*b* of the channel members 16.

It may be seen from the drawing that the ends 16*a* and 16*b* of each channel member 16 are spaced both horizontally and vertically. A vertically movable horizontal channel member 18 may be brought into register with either the end 16*a* or the end 16*b* of the channel members 16. It will be understood that the channel member 18 is provided with a pair of spaced channels which may be brought into register simultaneously with the ends of the channel members 16 on each side of the conveyor 2. In the position shown in the drawing the channel member 18 is in register with the end 16*b* of the channel members 16.

Movement of the channel member 18 between positions in register with the end 16*a* or 16*b* is controlled by a parallel linkage 20 pivotally connected to the channel member 18 at 22 and also pivotally mounted on vertically aligned pivots 24 and 26 on the outer face of one of the side plates 10. The linkage 20 carries cam rollers 28 and 30 which are acted on by inner and outer cams 32 and 34 respectively. The cams 32 and 34 are mounted on a rotatable shaft 36 in axially spaced positions, the shaft 36 being rotatably mounted on the adjacent side plate 10. The shaft 36 is rotated by means of gearing (not shown) engaged with a drive gear 38 rotatable and coaxial with the sprocket 8. The gearing is arranged so that the shaft 36 and the sprocket 8 rotate in the same direction (although this is not essential with differently shaped cams). Also driven by the drive gear 38 is a timing reference gear 40 by means of which synchronization of associated apparatus may be achieved. In order to allow the connection between the channel member 18 and the linkage 20, which lie on opposite sides of the side plate 10, the plate is provided with a cut-out window 42 which is large enough to allow full movement of the channel member 18 between its extreme positions.

In the region above the conveyor 2 approximately above the channel member 18 is a vertically movable control plate 44. The plate 22 is of about the same width as the conveyor 2 and has bevelled surfaces 44*a* and 44*b* spanning its width at each end. A support frame 46 is connected to the plate 44 and upper and lower arms 48 and 50 respectively of a parallel linkage are pivotally connected to this frame. The arms 48 and 50 are also adjustably connected by vertically aligned pivots to a fixed structure 52. The upper arm 48 extends beyond its pivotal connection to structure 52 and carries a weight 54, the position of which on the arm is adjustable.

The apparatus so far described with reference to the drawing is suitable for use in apparatus as disclosed and claimed in the aforesaid British patent specification No. 1,404,141, as part of the loading station described therein with reference to FIGS. 1 and 4 to 8 (as part of the loading station LS in the machine layout shown in FIG. 16), or as part of the combined loading and unloading station described with reference to FIGS. 19, 20 and 20A (as part of the storage unit SU in the machine layout shown in FIG. 17). Thus the conveyor 2 of the present apparatus may correspond in function with the conveyor 26 in FIG. 4 or the conveyor 128 in FIG. 19 of the apparatus disclosed in said specification. For fuurther details of the relationship of the present apparatus to ancillary equipment when used as part of apparatus as aforesaid, reference is directed to the aforesaid specification.

It may also be noted that the conveyor 2 may correspond in function with the conveyor 170 described with reference to FIGS. 1 and 2 of British patent specification No. 1,404,144.

Operation of the present apparatus will now be described, with reference to the accompanying drawing, in relation to its function as part of a loading station in which a stream consisting of a stack of cigarettes is fed onto the conveyor and subsequently divided into batches for transfer to a container. This function corresponds to the primary use envisaged for the apparatus and also corresponds to the (or a) function of apparatus described in the aforesaid specifications. It should be understood however that the present apparatus may be used simply to divide a stream of rod-like articles.

A stream consisting of a stack of cigarettes moving transverse to their lengths is fed onto the conveyor 2 at the left hand end of the upper horizontal run as seen in FIG. 1A of the drawing. The stream may be formed in any manner and will normally be supplied from one or more cigarette making machines. The sprockets 6 are driven clockwise by the servo motor so that the upper run of the conveyor 2 moves from left to right as viewed in the drawing. The lateral position of each divider plate 12 relative to its supporting slat **2*b* is fixed and it is maintained perpendicular to the surface of the slat at all times. This may be achieved, whilst allowing for perpendicular movement of the divider plate, for example by arranging pairs of circumferentially grooved rollers on each side of the divider plate and in the same plane, the rollers being rotatably supported by the special slat 2*b*** so that each side of the divider plate is constrained to move in the aligned grooves of the rollers.

The perpendicular position of each divider plate 12, i.e. the degree of retraction below or projection above the surface of the conveyor, is determined by the spacing of the conveyor and the channel members 16 in which the rollers 14 on the divider plates run. Thus at the right hand end of the upper run of conveyor 2, as viewed in the right hand part of FIG. 1A and in FIG. 1B, the divider plates 12 are fully projected above the conveyor since the channel members 16 and the conveyor 2 are adjacent. On the inclined run of the conveyor 2, however, when the channel members 16 and conveyor 2 progressively diverge between sprockets 6 and sprockets 8 the divider plates 12 are progressively withdrawn until around sprockets 8 they are fully retracted so that the outer end is slightly below the surface of the conveyor. This situation is maintained to the end **16*b* of the channel members 16**.

Consider now the situation with a stream of cigarettes on the conveyor 2 with a divider plate 12 positioned with its rollers 14 in the channel members 16 adjacent the end **16*b*. As just mentioned the spacing between the channel members 16 and the conveyor 2 at this point is such that the outer end of the divider plate is below the surface of the conveyor. The movable channel member 18 is at its lowermost position so that its channels are in register with the end 16*b*. As the conveyor 2 moves, carrying the stream of cigarettes, the slat 2*b* supporting the divider plate also moves so that the rollers 14 move from the channel members 16 into the movable channel member 18. Also as the conveyor 2 moves, the sprockets 8, drive gear 38 and associated gearing cause the shaft 36 and cams 32 and 34** to rotate.

It should be noted that cams 32 and 34 are conjugate and serve to respectively raise and lower the linkage 20. The shaping of the cams and the spacing of rollers 28 and 30 are such that the rollers are maintained continuously in contact with the surface of cams 32 and 34 respectively, thus ensuring a positive action for the mechanism. In a less satisfactory arrangement from this point of view the cam 32 alone could be used to lift the linkage 20 and gravity (or a spring) relied upon to lower the linkage. In effect, in the illustrated mechanism the cam 34 and roller 30 are provided to maintain roller 28 in contact with cam 32.

As soon as the rollers 14 of the divider plate 12 are on the channel member 18 the cam 32 begins to lift the roller 28 and the linkage 20. The linkage 20 in turn begins to lift the channel member 18 and ensures that it remains horizontal as it moves. The cam 32 has a steadily increasing radius which causes the channel member 18 to be lifted at a constant rate as the cam rotates. The outer end of the divider plate is lifted with the channel member 18 and is projected above the conveyor into the stream of cigarettes, following a locus 60 under the action of cam 32. (It will of course be understood that the conveyor 2 and hence slat **2*b* and the divider plate 12 continue to move to the right as viewed in the drawing as the cam drive shaft 36** rotates.)

When the cam 32 has reached a rotational position corresponding to the uppermost point of locus 60 there is a dwell period during which the position of the channel member 18 is maintained but not lifted further. During this dwell period the outer end of the divider plate 12 follows a locus 62. Subsequently the radius of cam 32 increases again causing the channel member 18 to rise steadily once more with the result that the outer end of the divider plate follows a locus 64.

When the cam 32 has reached its point of maximum lift the channel member 18 has reached its uppermost position and is in register with the end **16*a* of the channel member 16. Simultaneously the divider plate has reached the end of the channel member 18 and is immediately transferred to the channel members 16 as the conveyor 2 moves on. The transfer occurs without further lift of the divider plate, which is then fully projected above the conveyor 2 through the stream of cigarettes on the conveyor. The locus of the outer end of the divider plate 12 subsequently follows a straight path 66 parallel to the conveyor along its upper run. After the divider plate 12 is transferred from the channel member 18 the cams 34 and 32 cause the linkage 20 t0 return the channel member into register with the end 16*b* in readiness for the next divider plate 12**.

Returning now to the situation where a divider plate 12 is just beginning to project into the stream of cigarettes, the end of the divider plate therefore being on the lower part of the slope 60, the stream is bounded at its forward end by the previous divider plate already inserted into the stream and is being fed continuously onto the conveyor from a source (not shown). As the divider plate rises into the stream displacement of the surrounding cigarettes occurs. This may result in excessively uneven surface levels in the stream, which are undesirable for various reasons, not least of which is the possibility of damage to cigarettes if a batch of cigarettes of uneven height is plunged into a tray compartment designed to accept batches of constant height. The control plate 44, which is situated above the region where the divider plate rises through the stream, helps to reduce problems of uneven stream height.

The plate 44 is horizontal and rests on top of the cigarette stream on the conveyor. It is pivoted on a fixed structure 52 by means of a parallelogram linkage so that it can move up and down whilst remaining horizontal. The plate can, by means of the pivoted linkage, accommodate small variations in stack height and working variations in a set stack height; further adjustment for height is provided by the adjustable connection to fixed structure 52. The plate 44 is counterbalanced by a weight 54, the position of which can be adjusted to vary the pressure exerted on the top of the stream by the plate.

As the divider plate 12 is projected further into the stream, with consequent further displacement of cigarettes in the stream, the control plate 44 resting on the stream over the rising divider plate discourages any increase in the stack height at that position. It will be understood that the stream of cigarettes is being conveyed by the conveyor underneath the control plate 44 during this time and so to at least some degree the action of the control plate on top of the stream is a rolling or ironing action. It has already been noted that the movement of the divider plate into the stream is in two stages, there being a dwell period during which further movement into the stream is temporarily stopped. As indicated in the drawing this dwell period occurs when the outer end of the divider plate 12 is just under the trailing end of the control plate 44. It is believed that this assists in rolling away cigarettes which tend to lie directly above the rising divider plate 12. The subsequent upward movement of the divider plate is relatively short and does not give rise to substantial difficulties with uneven surface level.

The dimensions and shape of the locus 60 to 66 and its relationship to the control plate 44 may be varied. For example the length of the dwell zone 62 under the control plate may be extended to allow further time for cigarettes above the divider plate to be rolled away by the control plate. The spacing between the top of the divider plate in the zone 62 and the lower surface of the control plate may be of the order of one cigarette diameter. In an alternative mode of operation the rising divider plate is allowed just to touch the control plate at the top of its upward movement on slope 60 before entering the dwell zone: this ensures that the divider plate is fully through the stream. The steepness and length of slope 60 may be such that the initial part occurs before the stream enters the region under the control plate.

Although it has been mentioned that there may be a rolling action between the cigarettes and the control plate the lower surface of the latter need not have a very high (or indeed a very low) coefficient of friction. Polished stainless steel has been found satisfactory in this respect.

It was mentioned earlier that displacement of cigarettes occurs when a divider plate is projected into a stream. The present apparatus attempts to restrict at least to some extent vertical displacement. In order that physical compression of cigarettes should not be sufficient to cause damage, whilst allowing a reasonable pressure to be exerted by the control plate 44, it is preferable that the surface of the slats of the conveyor 2 should present relatively low friction to the movement of cigarettes so that bodily movement of the stream along the conveyor in order to take up any displacement caused by the insertion of the divider plate is not precluded. The slats of the conveyor may, for example, have surfaces of plastics material.

After a divider plate has been projected into the stream the control plate 44 continues to rest on top of the stream. Thus the ironing action of the plate is available for all the stream and not just that part above each divider plate. As an extension of its function the control plate may be used to set the stack height by restricting the height of a stream feed onto the conveyor. In this form it is conceivable that the plate could be fixed relative to the conveyor (although preferably adjustable for height) and simply define a height restricting zone in the region above the rising divider plate. Some pressure would still be exerted on the stream by the fixed control plate by reaction as the stream is fed by the conveyor into the restricted zone.

When a successive pair of divider plates have been fully projected into the stream the conveyor is temporarily stopped and the batch of cigarettes formed by the portion of the stream between the divider plates is pushed endwise transversely off the conveyor into an adjacent container, e.g. as described in the aforesaid patent specification. A variable buffer reservoir may be provided upstream of the conveyor 2, to absorb the flow of the stream of cigarettes from the source whilst the conveyor 2 is stopped for removal of a batch into a container. Immediately the batch has been removed from the conveyor the latter is restarted and formation of the next batch is continued.

Where a batch of cigarettes is to be transversely pushed from a conveyor into a container it is important that the cigarettes should be maintained in alignment since otherwise delay in operation or even damage to the apparatus may occur. Generally speaking, the cigarettes in the middle of a batch are unlikely to cause any trouble in this respect and it is in particular the cigarettes at or near the top ends of the batch which are most likely to become misaligned. Control of these latter cigarettes is made more difficult if the batch is retained by end plates whose height barely exceeds that of the batch. Moreover, the end plates may be rounded or bevelled tops (to allow them to be projected into a stream of cigarettes to form a batch) and some clearance must exist between the end plates and the pusher or plunger which transfers the batch from its conveyor into a container. As a result the clearance at the top corners of the batch may be such that insufficient control of the cigarettes in this region is exercised to prevent possible misalignment of the cigarettes as the batch is transferred. It is important to realise that the present arrangement at least partly overcomes this problem by providing apparatus whereby it is possible to ensure that the divider plates which form the end plates for the batches may be projected fully through the stream (without causing misalignment of the cigarettes in the upper part of the stream) and extend above the height of the stream when fully projected so that adequate control of the top ends of the batches may be achieved when the pusher is operated to transfer the batches transversely into a container. The movement of the rising divider plates and the presence of the control plate are both helpful in this respect.

It has already been mentioned that the present apparatus may be embodied as part of a storage unit SU (in the machine layout shown in FIG. 17 of British patent specification No. 1,404,141, for example). In this function the conveyor 2 is part of a combined loading and unloading station for containers for batches of cigarettes. This requires the conveyor 2 and its associated drive to be reversible so that batches unloaded from a container onto the conveyor between successive divider plates may be reformed into a continuous stream moving from right to left as viewed in the accompanying drawing. In this mode of operation the apparatus serves to remove divider plates from the batches so that a continuous stream of cigarettes is formed by the conveyor. The control plate 44 ensures that the stream so formed is subjected to a levelling action by "ironing" the upper surface of the stream. The successive divider plates at the leading end of the batches moving along the conveyor are withdrawn from the stream and retracted below the conveyor by the channel member 18 moving under the action of cams 32 and 34 (which are so shaped that reverse rotation is facilitated). Since the cams cause the divider plates to follow the same locus irrespective of whether they are being projected into the stream or withdrawn from it, downward movement of a divider plate in reverse operation of the apparatus takes place in two stages separated by a dwell zone. The initial downward stage of the movement of the divider plate preferably occurs at a position spaced somewhat from the control plate so that there is no risk of cigarettes being trapped between the edge of the control plate and the approaching divider plate.

In the case of a movable control plate such as the plate 44 it will of course be understood that a simple pivoting arrangement could be provided as an alternative to the linkage arrangement illustrated. Moreover resilient means may be relied upon instead of or in addition to weight to provide or counterbalance the acting pressure of the plate.

The apparatus has been described in relation to its function for handling cigarettes. Other rod-like articles, in particular multiple length filter plug rods, may also be handled by the apparatus described and that shown in the drawing.

We claim:

1. A method of dividing a stream consisting of a stack of rod-like articles moving transverse to their lengths, including the steps of moving dividing means with the stream and progressively projecting the dividing means into the stream so that said dividing means finally projects through said stream, subjecting the stream to transverse pressure in the region where the dividing means is projected into the stream, and releasing said pressure during final projection of said dividing means through the stream.

2. A method of dividing a stream consisting of a stack of rod-like articles moving transverse to their lengths, including the steps of moving dividing means with the stream and progressively projecting the dividing means into the stream, subjecting the stream to transverse pressure in the region where the dividing means is projected into the stream, further comprising projecting the dividing means into the stream in at least two distinct stages, and subjecting the stream to said transverse pressure during the initial or intermediate stage or stages only.

3. Apparatus for dividing a stream consisting of a stack of rod-like articles, comprising conveyor means for supporting and moving the stream, dividing means associated with the conveyor means and arranged to be projected upwards into the stream from a lower position retracted below the conveyor means, guide means for causing movement of the dividing means from the lower position to an upper position in which the dividing means is fully projected through the stream, and pressure means extending along said conveyor means for exerting a pressure on top of the stream over at least part of the region where the dividing means is moving through the stream, said pressure means terminating upstream of the upper position of said dividing means relative to said conveyor means.

4. Apparatus according to claim 3 wherein the pressure means comprises a plate spaced from the conveyor means and mounted so that it is movable towards or away from the conveyor means.

5. Apparatus according to claim 4 wherein the plate is pivoted on a counterbalanced parallelogram linkage.

6. Apparatus according to claim 3 wherein the conveyor means comprises an endless slatted coveyor.

7. Apparatus according to claim 3 wherein the dividing means comprises at least one divider plate carried by said conveyor means, including a follower member attached to the divider plate and a track adjacent the conveyor means, the follower member being constrained to follow said track.

8. Apparatus according to claim 7 wherein said guide means comprises a movable section of said track.

9. Apparatus according to claim 8 further including cam means arranged to impart reciprocal motion to the movable section of said track.

10. Apparatus for dividing a stream consisting of a stack of rod-like articles, comprising conveyor means for supporting and moving the stream, dividing means associated with the conveyor means and arranged to be projected upwards into the stream from a lower position retracted below the conveyor means, guide means for causing movement of the dividing means from the lower position to an upper position in which the dividing means is fully projected through the stream, and pressure means for exerting a pressure on top of the stream over at least part of the region where the dividing means is moving through the stream, wherein the dividing means and guide means are arranged so that the dividing means is projected into the stream in at least two distinct stages, the stages being separated by a dwell zone during which the dividing means remains at the same level above the conveyor means.

11. A method of dividing a stream consisting of a stack of rod-like articles moving transverse to their lengths, including the steps of moving dividing means with the stream and projecting the dividing means into the stream in at least two distinct stages separated by a dwell zone during which the dividing means is not projected further into the stream, and subjecting the stream to transverse pressure so that the height of the stream is slightly reduced in at least part of the region where the dividing means is projected into the stream.

12. Apparatus for dividing a stream consisting of a stack of rod-like articles, comprising conveyor means for supporting and moving the stream, dividing means associated with the conveyor means and arranged to be projected upwards into the stream from a lower position retracted below the conveyor means, guide means for causing movement of the dividing means from the lower position to an upper position in which the dividing means is fully projected through the stream, and means for reducing the height of a stream on said conveyor means in the region where said dividing means is projected into the stream.

13. Apparatus according to claim 12 wherein said reducing means comprises a pressure plate which is spaced from said conveyor means and extends in the direction of movement of said conveyor means for a distance which is less than the extend of the region where the dividing means is moving through the stream.

14. Apparatus according to claim 13 wherein the pressure plate has a bevelled leading edge to guide the uppermost rod-like articles in a stream on the conveyor means.

* * * * *